US005938134A

United States Patent [19]

Shields et al.

[11] Patent Number: 5,938,134

[45] Date of Patent: Aug. 17, 1999

[54] APPARATUS AND METHOD FOR WINDING STRANDS

[76] Inventors: Donald T. Shields; Loretta R. Shields, both of 14236 E. Germann Rd., Gilbert, Ariz. 95296

[21] Appl. No.: 09/030,759

[22] Filed: Feb. 25, 1998

[51] Int. Cl.[6] ..... B65H 49/30; B65D 30/22; B65D 69/00; B25G 3/00

[52] U.S. Cl. ..... 242/127; 206/223; 242/607; 242/901; 383/39; 383/86; 403/383; 403/DIG. 1

[58] Field of Search ..... 242/401, 470, 242/588, 607, 127, 901, 405.1; 403/DIG. 1, 383; 206/581, 223; 383/38, 39, 86

[56] References Cited

U.S. PATENT DOCUMENTS

| | | | |
|---|---|---|---|
| 607,674 | 7/1898 | Arrowsmith . | |
| 1,397,022 | 11/1921 | Townsend . | |
| 2,057,728 | 10/1936 | Lester . | |
| 2,287,368 | 6/1942 | Anderson . | |
| 2,423,533 | 7/1947 | Turner . | |
| 2,465,001 | 3/1949 | Walker . | |
| 3,096,040 | 7/1963 | Taylor, Jr. . | |
| 3,309,038 | 3/1967 | Greaney et al. . | |
| 4,038,775 | 8/1977 | Sato | 403/DIG. 1 X |
| 4,779,817 | 10/1988 | Bjork . | |
| 4,991,788 | 2/1991 | Pattison . | |
| 5,145,122 | 9/1992 | Poister . | |
| 5,167,449 | 12/1992 | Killough | 403/DIG. 1 X |
| 5,441,153 | 8/1995 | Lahaye | 383/38 X |
| 5,598,923 | 2/1997 | Owens | 383/39 X |

*Primary Examiner*—Michael R. Mansen
*Attorney, Agent, or Firm*—Schmeiser, Olsen & Watts

[57] ABSTRACT

A strand winder has three individual component pieces joined together at right angles by cooperating metal inserts and magnet inserts. Once assembled, the strand winding apparatus provides four arms for winding skeins of yarn, in preparation for knitting. In addition, an optional carrying case stores and transports the various components of the strand winder. The strand winder transportable, easily disassembled, and convenient to use in many situations where other, more conventional yarn-winding devices are cumbersome and bulky.

20 Claims, 4 Drawing Sheets

APPARATUS AND METHOD FOR WINDING STRANDS

BACKGROUND OF THE INVENTION

1. Technical Field

This invention relates generally to winding strands of material and more particularly to an apparatus and method for using a multi-armed apparatus to quickly and efficiently wind skeins of yarn for knitting.

2. Background Art

Many individuals have found that knitting is a relaxing and enjoyable hobby. Not only can a person create something with their hands, a hand-knitted item may become a valuable family keepsake. Knitting is very popular in the United States and around the world and can be viewed as a profession as well as a hobby. Hand-knitted items are typically durable and very much sought after.

While knitters typically need only a few basic supplies to begin knitting, i.e. needles and yarn, most knitters have found that it is very useful to have a device or apparatus to wind yarn on, prior to knitting. By winding the strands onto an apparatus, a "skein" or neat bundle of yarn can be formed. This makes the yarn easier to work with when knitting. This is especially true for those knitters who also choose to "spin" or make their own yarn from processed wool. As the wool is spun into yarn, it is formed into long, slender strands and these strands, if simply piled on the floor, may become a jumbled mess. In order to keep the yarn from becoming tangled, the yarn is typically wound or coiled onto an apparatus with spindles or arms to form neat, tidy loops of yarn, which are then ready to use. There are a number of patented devices which can be used to wind and store yarn for this purpose. For example, U.S. Pat. No. 1,397,022 issued to Townsend, illustrates a yarn winding implement which allows yarn to be wound into balls which can then be used for knitting. This apparatus is essentially a cross-shaped configuration with the two cross members being removably attached to each other. While yarn balls are very popular, skeins in the form of a continuous loop are preferred by many knitters.

U.S. Pat. No. 607,674 is a multi-fingered collapsible device with a webbing material between the fingers. The fingers are connected at one end by a pivot. This allows the fingers to be spread out and clamped in various configurations, as desired, for winding yarn. The adjustable nature of the device allows many different sizes of yarn skeins to be wound. While useful, this device does not allow a knitter to make elongated continuous loop skeins, but produces a coil of yarn, similar to winding the yarn on a person's hand.

Other, multi-armed strand winding implements are also known. However, these implements are usually bulky and inconvenient to work with for a variety of reasons. They often have one or more spindle-type arms fixed at right angles to another arm, which will often lead to accidental breakage if the implement is transported frequently. In addition, some strand winding implements are assembled with clamps, nuts and bolts, or screws. While these implements can be disassembled, the process requires tools and an undesirable amount of time. Once disassembled, these yarn-winding implements must be reassembled, once again using tools as part of the process. Many of the multi-armed yarn-winding implements also have knobs on the ends of the arms, making yarn removal a difficult task.

While all of the known yarn-winding implements are somewhat useful, they are not readily adaptable for certain uses and situations. Specifically, most previously known multi-armed yarn-winding devices are somewhat bulky and do not easily lend themselves to disassembly, transport, or storage. This is especially inconvenient for knitters who travel frequently or who wish to carry a limited amount of baggage with them from place to place. There are no truly portable, easy to disassemble and store, multi-armed yarn-winding implements available today. Without a multi-armed apparatus and method for more efficiently winding yarn and other stranded materials, knitters will continue to be limited by the less-useful implements presently available.

DISCLOSURE OF THE INVENTION

According to the preferred embodiments of the present invention, an apparatus and method for winding strands is disclosed. The apparatus of the present invention is comprised of three individual component pieces joined together at right angles by cooperating metal inserts and magnets. Once assembled, the strand winding apparatus provides four arms for winding skeins of yarn, in preparation for knitting. In addition, an optional carrying case for storing and transporting the various components of the apparatus is disclosed. The apparatus of the present invention is transportable, easily disassembled, and convenient to use in many situations where other, more conventional yarn-winding devices are cumbersome and bulky.

BRIEF DESCRIPTION OF THE DRAWINGS

The preferred embodiments of the present invention will hereinafter be described in conjunction with the appended drawings, wherein like designations denote like elements, and.

BEST MODE FOR CARRYING OUT THE INVENTION

Figure 1:
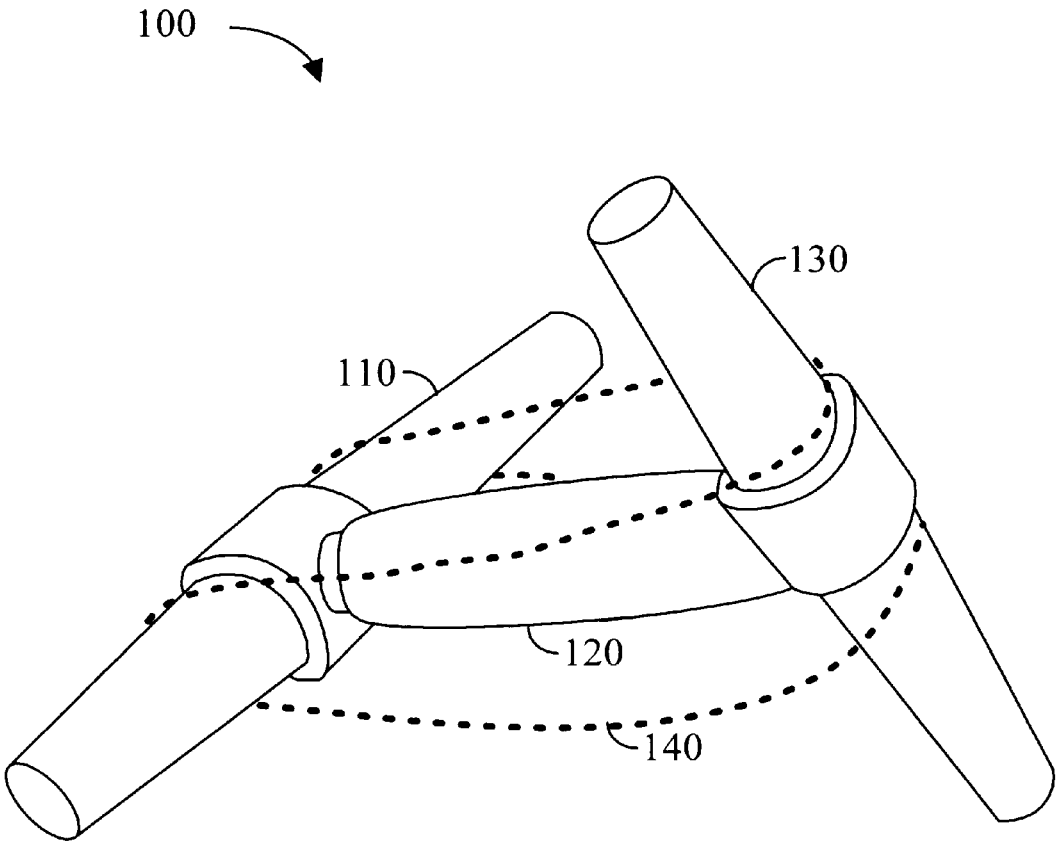
FIG. 1 is a perspective view of an assembled apparatus for winding strands according to a preferred embodiment of the present invention.

Referring now to FIG. 1, an assembled apparatus for winding strands according to a preferred embodiment of the present invention includes three separate pieces: a first end piece 110; and central piece 120; and a second end piece 130. As explained below, first end piece 110 and second end piece 130 are removably attached to central piece 120 by a force of magnetic attraction. In the most preferred embodiments, each of the three individual pieces is generally symmetrical about its individual axis and each of the axes are perpendicular to the other two axes. With this multi-armed configuration, yarn can be quickly and easily wound about the apparatus, forming skeins, as shown by dotted line 140.

Figure 2:
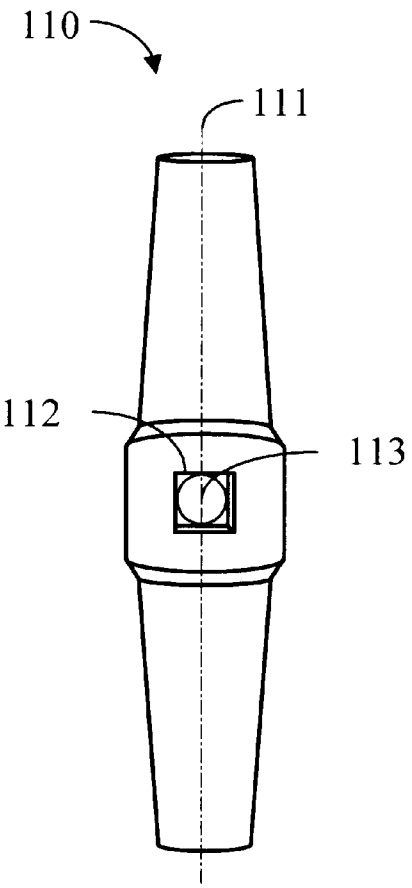
FIG. 2 is a front view of a first end piece of the apparatus of FIG. 1.

Referring now to FIG. 2, first end piece 110 includes: a central axis 111; an opening 112; and a magnetic insert 113. Opening 112 is a small, square or rectangular hole hollowed out or fabricated in the body of first end piece 110. Opening 112 extends approximately ½ to ¾ of the way into the body of first end piece 110. Magnetic insert 113 is a small piece of magnetic material and is sized to fit easily into opening 112 and rests in the bottom of opening 112. Magnetic insert 113 and is typically secured in place by a small amount of glue or other adhesive material. Magnetic insert 113 is any type of magnetic material which is capable of creating and sustaining a force of magnetic attraction suitable for the purposes described herein.

Figure 3:
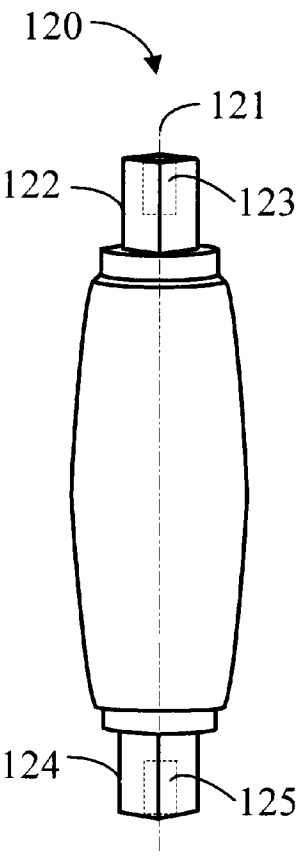
FIG. 3 is a front view of the central piece of the apparatus of FIG. 1.

Referring now to FIG. 3, central piece 120 includes: a central axis 121; a first end 122; a second end 124; a first metal insert 123; and a second metal insert 125. First end 122 and second end 124 are generally square or rectangular in shape and are sized to fit snugly into opening 112 and opening 132. In the most preferred embodiments of apparatus 100, first end 122 and second end 132 are identical in shape.

Metal inserts 123 and 125 are any type of metal known to those skilled in the art which are suitable for use with magnetic insert 113 (FIG. 2) and magnetic insert 133 (FIG. 4) to create a force of magnetic attraction between the various components of apparatus 100. In the most preferred embodiments of the present invention, metal inserts 123 and 125 are simply flat-headed wood screws, inserted into first end 122 and second end 124 of central piece 120 with a screwdriver. However, any type of metal which is attracted to magnetic inserts 123 and 125 may be used. As discussed below in conjunction with FIG. 5, metal inserts 123 and 125 cooperate with magnetic inserts 113 and 133 to hold the various pieces of knitting apparatus 100 in place.

Figure 4:
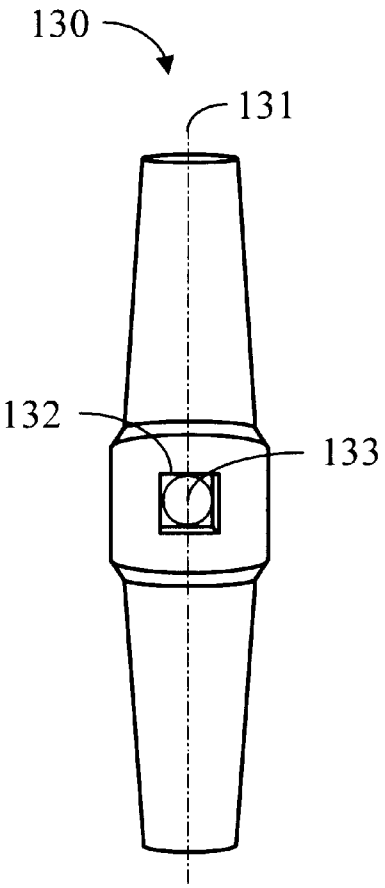
FIG. 4 is a front view of a second end piece of the apparatus of FIG. 1.

Referring now to FIG. 4, second end piece 130 includes: a central axis 131; an opening 132; and a magnetic insert 133. As with first end piece 110, opening 132 is a small, square or rectangular hole hollowed out or fabricated in the body of second end piece 130. Opening 132 extends approximately ½ to ¾ of the way into the body of second end piece 130. Magnetic insert 133 is a small piece of magnetic material and is sized to fit easily into opening 132 and rests in the bottom of opening 132. Magnetic insert 133 is typically secured in place by a small amount of glue or other adhesive. In the most preferred embodiment of apparatus 100, openings 112 and 132 are the exact same size and depth in their respective end piece 110 and 130. This allows greater flexibility in assembling apparatus 100 by creating an interchangeable relationship between first end piece 110 and second end piece 130 with respect to central piece 120. In addition, it should be noted that although openings 112 and 132 are herein characterized in the most preferred embodiment as being square or rectangular, other flat-sided geometric shapes such as triangles, hexagons, etc. may also be employed. The most preferred shapes will prevent rotation of first end piece 110 and second end piece 130 with respect to central piece 120.

Figure 5:
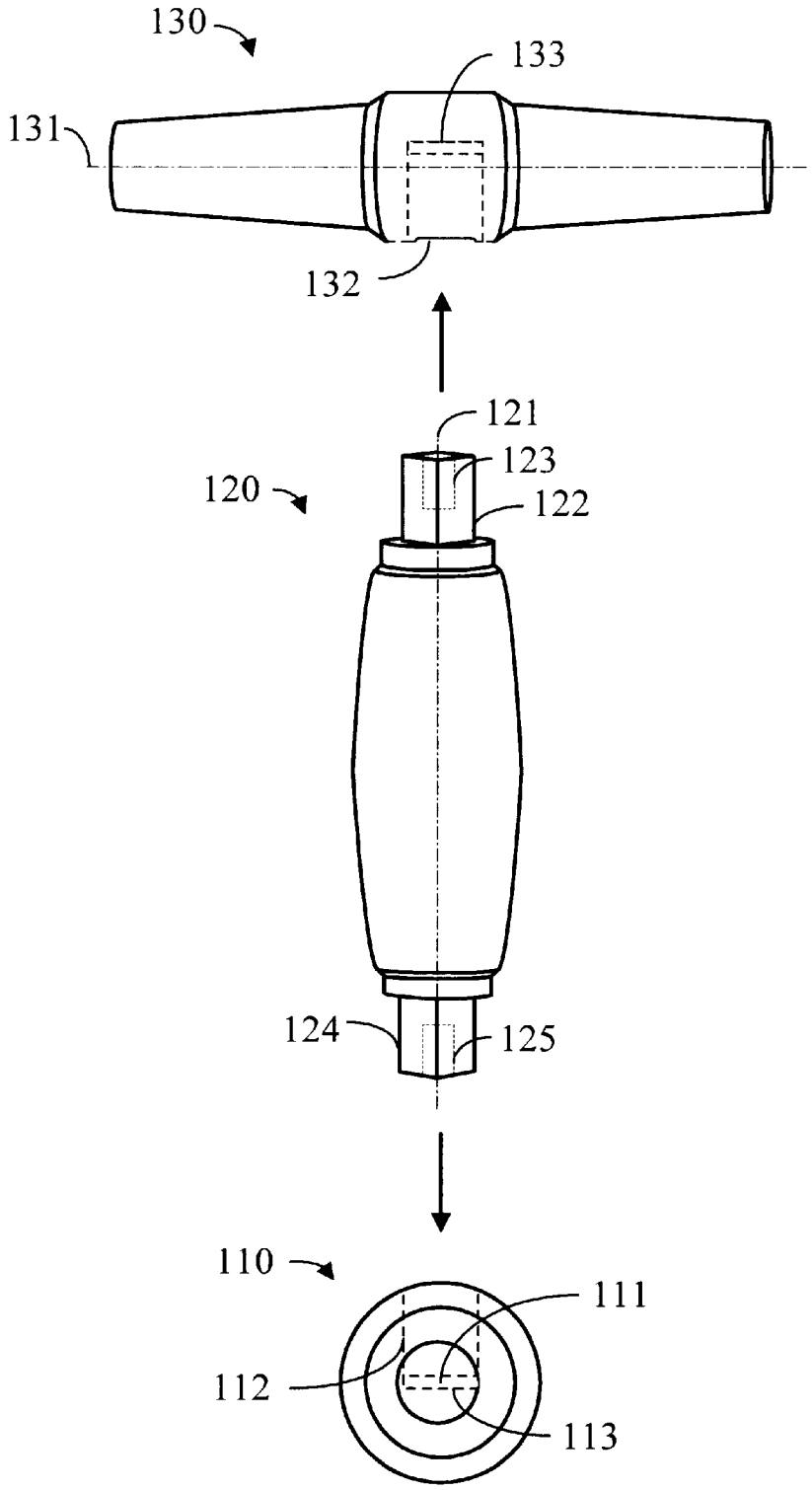
FIG. 5 is a perspective view showing the assembly method of the various components of an apparatus for winding strands according to a preferred embodiment of the present invention.

Referring now to FIG. 5, apparatus 100 is assembled by inserting first metal insert 121 of central piece 120 into opening 132 of second end piece 130 until first metal insert 121 contacts magnetic insert 133, joining second end piece 130 to central piece 120. Similarly, second metal insert 125 of central piece 120 is inserted into opening 112 of first end piece 110 until it contacts magnetic insert 113. As shown in FIG. 5, once apparatus 100 is assembled, central axis 121 of central piece 120 is perpendicular to central axis 111 of first end piece 110. Also, central axis 121 of central piece 120 is perpendicular to central axis 131 of second end piece 130. Finally, central axis 111 of first end piece 110 is perpendicular to central axis 131 of second end piece 130.

This combination of perpendicular pieces allows assembled apparatus 100 to be used for its intended purpose by providing a useful arrangement of arms for winding yarn or other stranded material. The force of attraction between the various components of apparatus 100 can be varied and controlled by selecting metal inserts 123 and 125 to use in conjunction with various sizes and strengths of magnetic inserts 113 and 133. Since different magnetic materials and metals have varying magnetic properties and capacities, the force of magnetic attraction between the various pieces can be easily varied. It is important to note that the force of magnetic attraction between metal inserts 123 and 125 and magnetic inserts 113 and 133 must be strong enough to hold the components together, but not so strong as to make disassembly difficult. A fairly small force of magnetic attraction is usually sufficient.

Since the various pieces of apparatus 100 are symmetrical, central piece 120 may be flipped end-for-end assembly purposes (i.e., first metal insert 121 of central piece 120 may be inserted into opening 112 of first end piece 110 until first metal insert 121 contacts magnetic insert 113, joining first end piece 110 to central piece 120). Similarly, second metal insert 125 of central piece 120 is then inserted into opening 132 of second end piece 130 until it contacts magnetic insert 133. In addition, in the most preferred embodiments, first end piece 110 and second end piece 130 are identical in shape and size and, therefore, are considered interchangeable.

It is also important to note that, when inserted into openings 112 and 132, square or rectangular ends 122 and 124 of central piece 120 minimize or completely prevent any rotational movement of end pieces 110 and 130 with respect to central axis 121 of central piece 120. This feature, coupled with the force of magnetic attraction between metal inserts 123 and 125 and magnetic inserts 113 and 133, serves to fix the various components in place to create a very stable apparatus 100.

Figure 6:
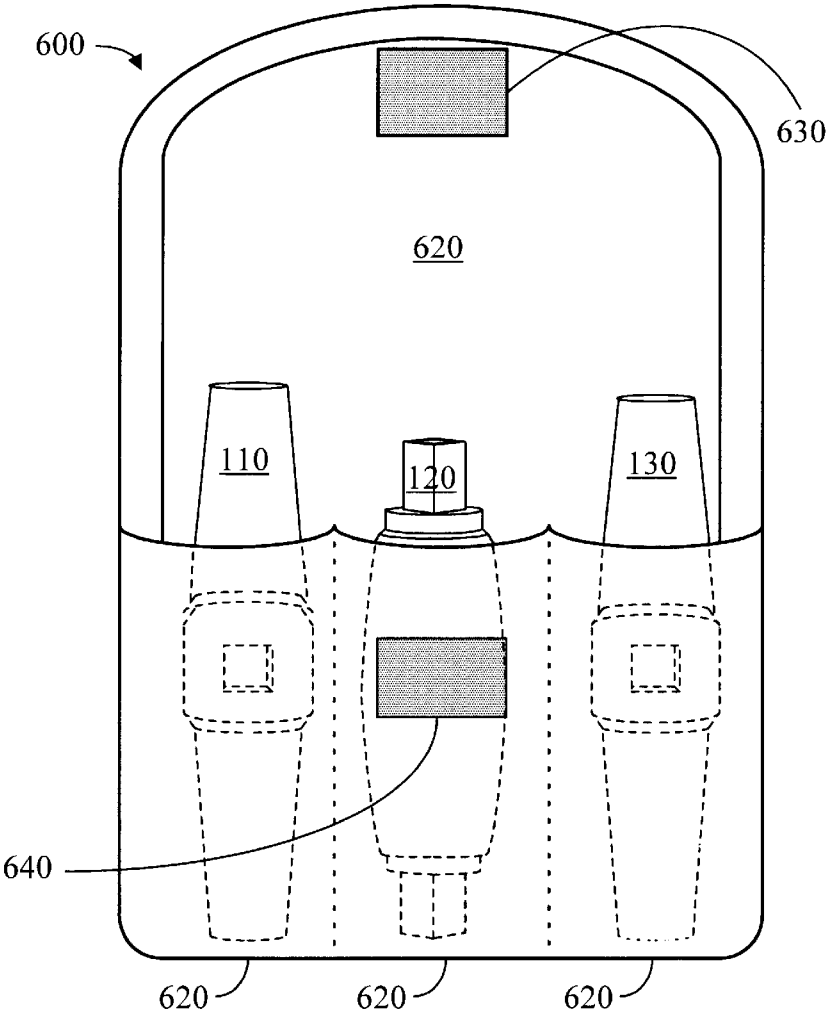
FIG. 6 is a front view of the apparatus of FIG. 1, disassembled and stored in an open protective carrying case according to a preferred embodiment of the present invention.

Referring now to FIG. 6, a carrying case 600 for the component pieces of apparatus 100 is illustrated. As shown in FIG. 6, carrying case 600 includes: a repositionable flap portion 610; a series of pockets 620; a hook-and-loop fastener 630 and a cooperating hook-and-loop tab 640. Hook-and-loop fastener 630 and hook-and-loop tab 640 are made from a hook-and-loop material such as Velcro®. First end piece 110, second end piece 130, and central piece 120 are each stored in a pocket 620. Once these three pieces are in place, repositionable flap portion 610 is folded over first end piece 110, second end piece 130, and central piece 120 and secured in place by attaching hook-and-loop fastener 630 to cooperating hook-and-loop tab 640. Carrying case 600 is used to store and transport apparatus 100 when not in use. Carrying case 600 is preferably manufactured from a durable, lightweight material such as cotton. However, leather, vinyl, ripstop nylon, and other similar materials may be used.

Figure 7:
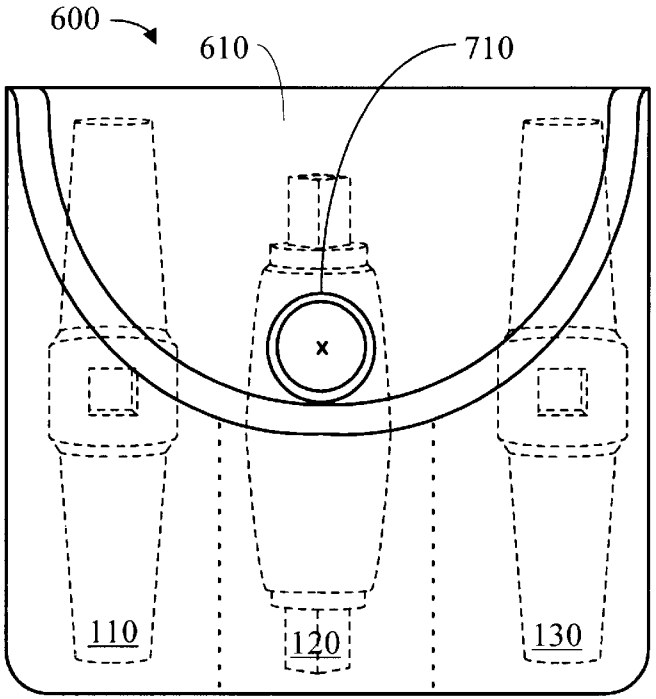
FIG. 7 is a front view of the protective carrying case of FIG. 6, in the closed position.

Referring now to FIG. 7, carrying case 600 is shown with flap portion 610 folded over and secured in place to cover and protect first end piece 110, second end piece 130, and central piece 120. If desired, a decorative button 710 or other accouterments may be attached to carrying case 600 to enhance the aesthetic appeal of carrying case 600. With flap portion 610 secured in place, apparatus 100 can be easily and safely transported from place to place. This disassembled three-piece arrangement overcomes the problems associated with most known knitting apparatus as discussed above.

While the invention has been particularly shown and described with reference to preferred embodiments thereof, it will be understood by those skilled in the art that various changes in form and details may be made therein without departing from the spirit and scope of the invention. For example, magnetic pieces could be placed on the ends of central piece 120 and metal inserts could be placed inside openings 112 and 132, thereby achieving the same effect. Alternatively, magnetic inserts could be used throughout, taking care to align the poles.

We claim:

1. An apparatus comprising:

a central piece of a strand-winding apparatus;

a first end piece removably attached to the central piece by a magnet; and a second end piece removably attached to the central piece by a magnet.

2. The apparatus of claim 1 wherein the central piece further comprises a first end with a flat-sided shape and a second end with a substantially flat-sided shape and wherein the first end piece and the second end piece each further comprise a substantially flat-sided opening sized to receive the first end or the second end of the central piece, the flat-sided ends and the flat-sided openings cooperating to prevent rotational movement of the central piece with respect to the first end piece and the second end piece.

3. The apparatus of claim 1 wherein the central piece further comprises a first end with a substantially square shape and a second end with a substantially square shape and wherein the first end piece and the second end piece each further comprise a substantially square opening sized to receive the first end or the second end of the central piece, the square ends and the square openings cooperating to prevent rotational movement of the central piece with respect to the first end piece and the second end piece.

4. The apparatus of claim 1 wherein the central piece of the strand-winding apparatus further comprises a central longitudinal axis and wherein the first end piece further comprises a first longitudinal axis and wherein the second end piece further comprises a second longitudinal axis and where the central longitudinal axis is perpendicular to the first longitudinal axis and where the central longitudinal axis is perpendicular to the second longitudinal axis and where the first longitudinal axis is perpendicular to the second longitudinal axis.

5. The apparatus of claim 1, wherein the first end piece comprises an opening with a magnetic insert affixed inside the opening and wherein the central piece comprises a first end and a second end, wherein the first end and the second end each have a metal insert and wherein the second end piece comprises an opening with a magnetic insert affixed inside the opening, and where the central piece is removably attached to the second end piece by a force of magnetic attraction between the metal insert of the first end and the magnetic insert inside the opening in the second end piece and where the central piece is removably attached to the first end piece by a force of magnetic attraction between the metal insert of the second end and the magnetic insert inside the opening in the first end piece.

6. The apparatus of claim 1 in combination with a storage case for receiving the central piece and the first end piece and the second end piece, when the strand-winding apparatus is disassembled.

7. The apparatus of claim 6 wherein the storage case further comprises a plurality of pockets, wherein the central piece is received within one of the plurality of pockets and wherein the first end piece is received within one of the plurality of pockets and wherein the second end piece is received within one of the plurality of pockets.

8. The apparatus of claim 6 wherein the storage case further comprises a repositionable flap portion removably fixed in position over the central piece and the first end piece and the second end piece, thereby covering the central piece and the first end piece and the second end piece.

9. An apparatus for winding stranded material comprising:

a central piece, the central piece comprising a first end and a second end, wherein the first end and the second end each have a metal insert;

a first end piece, the first end piece comprising an opening with a magnetic insert affixed inside the opening;

a second end, the second end piece comprising an opening with a magnetic insert affixed inside the opening;

wherein the central piece is removably attached to the first end piece by a force of magnetic attraction between the metal insert of the second end and the magnetic insert in the first end piece; and wherein the central piece is removably attached to the second end piece by a force of magnetic attraction between the metal insert of the first end and the magnetic insert in the second end piece.

10. The apparatus of claim 9 wherein the central piece further comprises a central longitudinal axis and wherein the first end piece further comprises a first longitudinal axis and wherein the second end piece further comprises a second longitudinal axis and where the central longitudinal axis is perpendicular to the first longitudinal axis and where the central longitudinal axis is perpendicular to the second longitudinal axis and where the first longitudinal axis is perpendicular to the second longitudinal axis.

11. The apparatus of claim 9 wherein the first end has a substantially square shape and the second end has a substantially square shape and wherein the opening of the first end piece and the second end piece each are substantially square, and wherein the square ends and the square openings cooperating to prevent rotational movement of the central piece with respect to the first end piece and the second end piece.

12. The apparatus of claim 9 in combination with a storage case for receiving the central piece and the first end piece and the second end piece, when the strand-winding apparatus is disassembled.

13. The apparatus of claim 12 wherein the storage case further comprises a plurality of pockets, wherein the central piece is received within one of the plurality of pockets and wherein the first end piece is received within one of the plurality of pockets and wherein the second end piece is received within one of the plurality of pockets.

14. The apparatus of claim 13 wherein the storage case further comprises a repositionable flap portion removably fixed in position over the central piece and the first end piece and the second end piece, thereby covering the central piece and the first end piece and the second end piece.

15. An apparatus for winding strands of yarn into skeins in combination with a storage apparatus comprising:

a central piece, the central piece comprising a first end and a second end, wherein the first end and the second end are each substantially square and wherein the first end and the second end each have a metal insert;

a first end piece, the first end piece comprising a substantially square opening with a magnetic insert affixed inside the square opening;

a second end, the second end piece comprising a substantially square opening with a magnetic insert affixed inside the square opening; and a storage case for storage of the central piece, the first end piece, and the second end piece when the apparatus for winding strands is disassembled, the storage case having a plurality of pockets, wherein the central piece is received within one of the plurality of pockets and wherein the first end piece is received within one of the plurality of pockets and wherein the second end piece is received within one of the plurality of pockets.

16. The apparatus of claim 15 wherein the central piece further comprises a central longitudinal axis and wherein the first end piece further comprises a first longitudinal axis and wherein the second end piece further comprises a second longitudinal axis and where the central longitudinal axis is perpendicular to the first longitudinal axis and where the central longitudinal axis is perpendicular to the second longitudinal axis and where the first longitudinal axis is perpendicular to the second longitudinal axis.

17. The apparatus of claim 15 wherein the storage case further comprises a repositionable flap portion removably fixed in position over the central piece and the first end piece and the second end piece, thereby covering the central piece and the first end piece and the second end piece.

18. A method of assembling an apparatus for winding stranded material comprising:

removably attaching a first end piece to a central piece of a strand-winding apparatus by aligning a square opening of the first end piece with a square end on the central piece in close proximity of each other, and using a magnet to hold the pieces together; and removably attaching a second end piece to the central piece by aligning a square opening of the second end piece with a square end on the central piece in close proximity of each other, and using a magnet to hold the pieces together.

19. The method of claim 18 wherein the step of attaching a first end piece to a central piece comprises the step of inserting a first metal insert located on a first end of the central piece into an opening in the first end piece.

20. The method of claim 18 wherein the step of attaching a second end piece to the central piece comprises the step of inserting a second metal insert located on a second end of the central piece into an opening in the second end piece.

* * * * *